US009364059B1

(12) United States Patent
Hicks

(10) Patent No.: US 9,364,059 B1
(45) Date of Patent: Jun. 14, 2016

(54) TROLLEY SUITCASE WITH DEPLOYABLE CONTAINER

(71) Applicant: Brian Hicks, Bakersfield, CA (US)

(72) Inventor: Brian Hicks, Bakersfield, CA (US)

( * ) Notice: Subject to any disclaimer, the term of this patent is extended or adjusted under 35 U.S.C. 154(b) by 162 days.

(21) Appl. No.: 13/794,479

(22) Filed: Mar. 11, 2013

(51) Int. Cl.
*A45C 5/06* (2006.01)
*A45C 13/28* (2006.01)

(52) U.S. Cl.
CPC .. *A45C 5/06* (2013.01); *A45C 13/28* (2013.01)

(58) Field of Classification Search
CPC ..... A45C 5/06; A45C 13/28; A45F 2005/002
See application file for complete search history.

(56) References Cited

U.S. PATENT DOCUMENTS 4,538,709 A * 9/1985 Williams et al. ..... 190/18 A
7,188,714 B1 * 3/2007 Herold ..... A63B 55/60 190/115
D552,349 S * 10/2007 Greiner ..... D3/278
7,510,157 B2 * 3/2009 Oliver ..... 248/311.2
7,971,764 B2 * 7/2011 Sabbah ..... 224/650
8,485,327 B1 * 7/2013 Dalrymple ..... 190/11
2002/0074199 A1 * 6/2002 Albritton ..... A45C 3/00 190/107
2005/0077135 A1 * 4/2005 Drew et al. ..... 190/102
2006/0196744 A1 * 9/2006 Greiner ..... A45C 13/02 190/110
2007/0138222 A1 * 6/2007 Goldman ..... 224/401

* cited by examiner

*Primary Examiner* — Tri Mai
(74) *Attorney, Agent, or Firm* — R. Scott Kimsey, Esq.; Klein DeNatale Goldner

(57) ABSTRACT

A trolley suitcase with deployable storage includes a front panel and a back panel. The front and back panels both have top and bottom edges, as well as first and second opposing side edges. An extendable handle extends from the top edge of the back panel and is moveable between a recessed position and an extended position. A deployable container is provided, deployable to define an auxiliary storage compartment external to the main storage compartment. The deployable container has a stored configuration and a deployed configuration. When in the stored configuration, the deployable container is collapsed, such that a first end thereof and a second end thereof are in adjacent positions. When in the deployed configuration, the first end of the deployable container is retained at its original position, while the second end of the deployable container is extended away from the first end. The auxiliary storage compartment is defined between the first end and the second end of the deployable container.

11 Claims, 7 Drawing Sheets

TROLLEY SUITCASE WITH DEPLOYABLE CONTAINER

RELATED APPLICATIONS

Not Applicable.

BACKGROUND OF THE INVENTION

1. Field of the Invention

The present invention relates generally to a trolley suitcase, and more specifically to a trolley suitcase having a deployable storage container.

2. Background

Suitcases are well-known in the art and come in a variety of styles, sizes, and shapes. They are constructed from metal, cloth, canvas, vinyl, or other suitable materials. At least one carrying handle is typically provided. Suitcases are indispensable for the transport and storage of personal items in modern travel.

Suitcases designed for ease of transport when traveling often provide at least one pair of wheels along a bottom surface of the suitcase, and many include a retractable handle that extends from an upper surface of the suitcase. These suitcases are commonly known as "trolley suitcases." These suitcases are easy for a traveler to transport. The traveler simply extends the handle and pulls the suitcase behind herself when traveling.

Increasingly, the size of a suitcase has a great deal of importance to the traveler. Airlines often charge fees for checked luggage, and carry-on luggage, such as some smaller trolley suitcases, is limited by size. Travelers tend to utilize all available luggage space during traveling. During travel itself, however, there is often a need for temporary or interim storage space. For example, a traveler may have an item such as a newspaper, book, pair of glasses, small electronic device, or other such item on hand while traveling, and may need to store the item temporarily while using a restroom, approaching a ticket counter, purchasing food or drink, and so on. At these times, it is inconvenient to open the main storage compartment of a suitcase in order to attempt to stow the item in the main storage compartment until the traveler returns to the bag. A temporary or interim storage compartment associated with a piece of luggage is desirable for allowing a traveler to temporary stow an item out of site without disturbing the packing in a suitcase's primary storage compartment, or going through the trouble of opening the main storage compartment just to temporarily store the item.

SUMMARY OF THE INVENTION

The present invention provides a suitcase having a front panel and a back panel. The front and back panels both have top and bottom edges, as well as first and second opposing side edges. An extendable handle extends from the top edge of the back panel and is moveable between a recessed position and an extended position. A deployable container is provided, deployable to define an auxiliary storage compartment external to the main storage compartment. The deployable container has a stored configuration and a deployed configuration. When in the stored configuration, the deployable container is collapsed, such that a first end thereof and a second end thereof are in adjacent positions. When in the deployed configuration, the first end of the deployable container is retained at its original position, while the second end of the deployable container is extended away from the first end. The auxiliary storage compartment is defined between the first end and the second end of the deployable container.

Another aspect of the invention provides a container storage housing defining a container storage space for storing the deployable container when the deployable container is in stored configuration. The container storage housing is contained within either one of the front panel and the back panel. The container storage space defined by the container storage housing is separate from the main storage space.

In another aspect of the invention, the first end of the deployable container is attached to either one of the front panel and the back panel, and the second end of the deployable container is attached to the extendable handle. When the extendable handle is in extended position, the deployable container is in deployed configuration.

In another aspect of the invention, the deployable container defines an access opening in an outer surface thereof for allowing access into an interior space of the deployable container.

In another aspect of the invention, the access opening includes a fastener for opening and closing the access opening.

In another aspect of the invention, the fastener is a zipper.

Another aspect of the invention provides that the deployable container is deployed between a stored configuration and a deployed configuration by a mechanized action.

In another aspect of the invention, the position of the first end of the deployable container when in deployed configuration is at a first location along the front panel. The position of the second end of the deployable container when in deployed configuration is at a second location along the front panel. The first and second locations are removed from one another.

In another aspect of the invention, the front panel includes a storage container housing. The storage container housing is positioned at the first location along the front panel, and the first end of the deployable container is attached to the storage container housing.

In another aspect of the invention, the front panel includes an attachment at the second location therealong. The deployable container includes an attachment at the second end thereof. The attachment of the front panel and the attachment of the deployable container are adapted to attach to one another.

Another aspect of the invention provides an interim storage device for providing temporary storage space on a suitcase having a front panel and a back panel. The front and back panels each have top and bottom edges, as well as first and second opposing side edges. The front and back panels together define a main storage compartment. An extendable handle is provided moveable between a recessed position and an extended position, extending from the top edge of the back panel. The interim storage device comprises a deployable container extending between a first point along the length of the extendable handle and a second point at either one of the front panel, the back panel, and a second point along the length of the extendable handle.

DETAILED DESCRIPTION OF THE INVENTION

Figure 1:
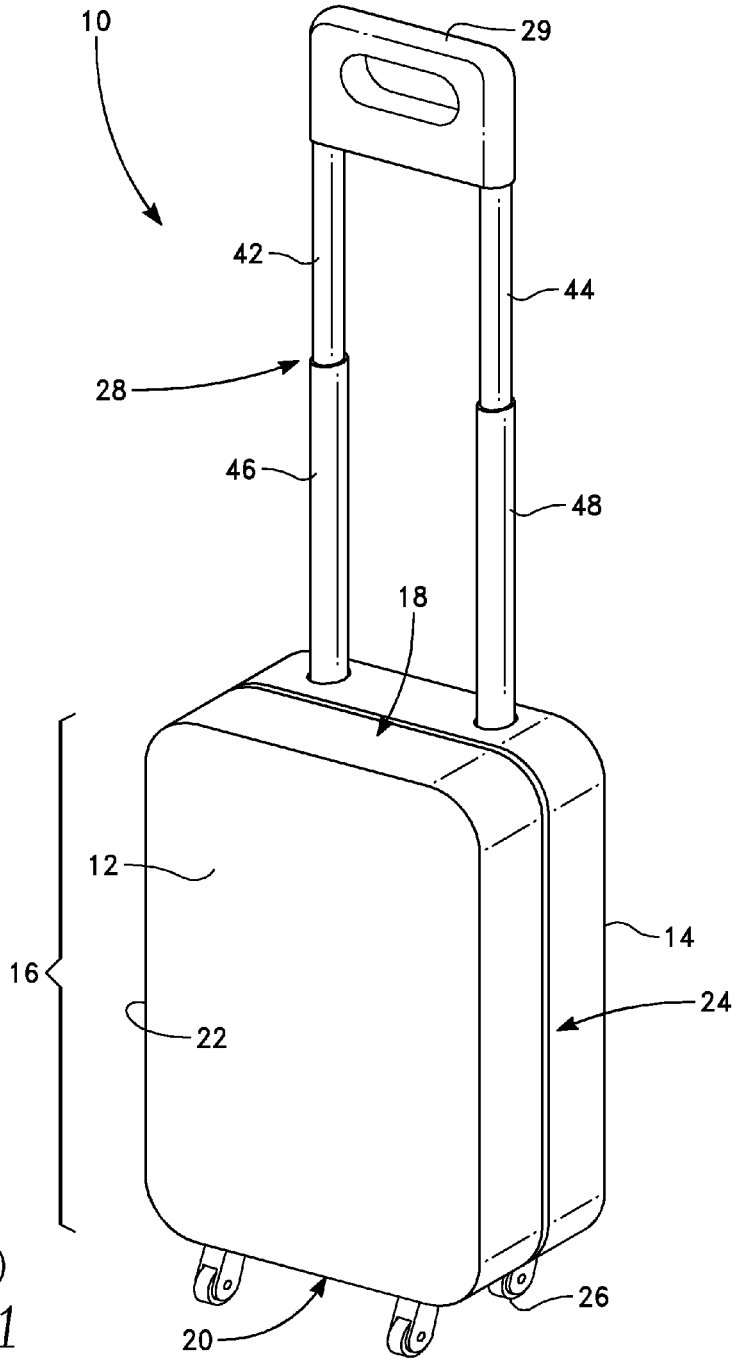
(Prior Art) FIG. 1
FIG. 1 is a perspective view of a prior art trolley suitcase.

Turning to the drawings, wherein like numerals indicate like parts, the numeral 10 refers generally to a prior art trolley suitcase suitable for modification in accordance with the teachings of the present invention. Trolley suitcase 10 includes a front panel 12 and a rear panel 14. Front panel 12 and rear panel 14 combine to define an main storage compartment 16. When assembled or combined as shown in the drawings, front panel 12 and rear panel 14 form a top surface 18 and a bottom surface 20 of trolley suitcase 10. Opposing sidewalls 22 and 24 are also present when trolley suitcase 10 is in assembled form, the sidewalls formed by the edges of the respective panels.

At least one pair of wheels 26 is attached to bottom surface 20 of trolley suitcase 10. An extendable handle 28 is contained within trolley suitcase 10 and is extendable from top surface 18 when in use. When not in use, extendable handle 28 is preferably recessed within trolley suitcase 10. In the embodiment of the present invention shown in the drawings, extendable handle 28 is a telescoping handle with two smaller-diameter tubes 42 and 44 and two larger-diameter tubes 46 and 48, where the smaller-diameter tubes are insertable into the two larger-diameter tubes. Extendable handle 28 also includes a grip 29. The present trolley suitcase 10 can be tilted and pulled as usual when extendable handle 28 is in extended form.

FIG. 1 shows the features of a trolley suitcase 10 discussed above and known in the art. Variations on the description above are also known in the art, and it is contemplated that the teachings of the present invention may be utilized in conjunction with any suitable prior art suitcase, including trolley suitcases or conventional, non-trolley suitcases.

Figure 2:
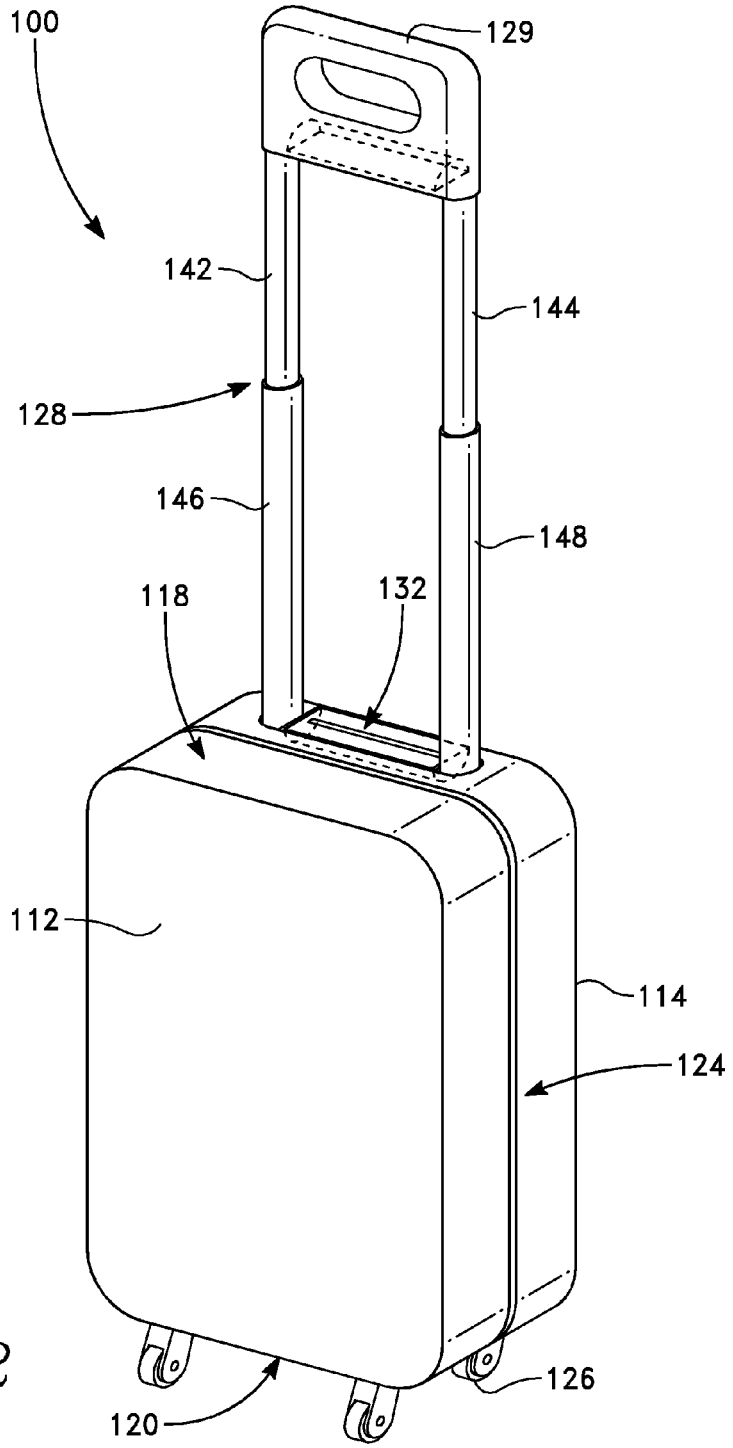
FIG. 2 is a perspective view of one exemplary embodiment of a trolley suitcase with deployable container of the present invention.

FIG. 2 shows one exemplary embodiment 100 of a trolley suitcase of the present invention. The present invention includes a deployable container 130 having a first end 131 and a second end 133 that can be deployed by the user of the present device when necessary or desirable. The deployment of deployable container 130 can be manual or automatic, as discussed in greater detail, below. As shown in the drawings, deployable container 130 may be provided in the form of a bag. It is contemplated, however, that any suitable container may be utilized.

In one embodiment of the present invention, as shown in FIG. 2, deployable container 130 is attached, at first end 131, to the body of trolley suitcase 100 at container storage housing 132 located along the top of rear panel 114. Second end 133 of deployable container 130 is attached along a length of smaller-diameter tubes 142 and 144 of extendable handle 128. The first end 131 of the deployable container 130 is preferably recessed within container storage housing 132, which is where deployable container 130 is in undeployed or stored configuration. In some embodiments of the invention, deployable container 130 may be attached to grip 129 of extendable handle 128 rather than along the length of smaller diameter tubes 142 and 144.

Figure 3:
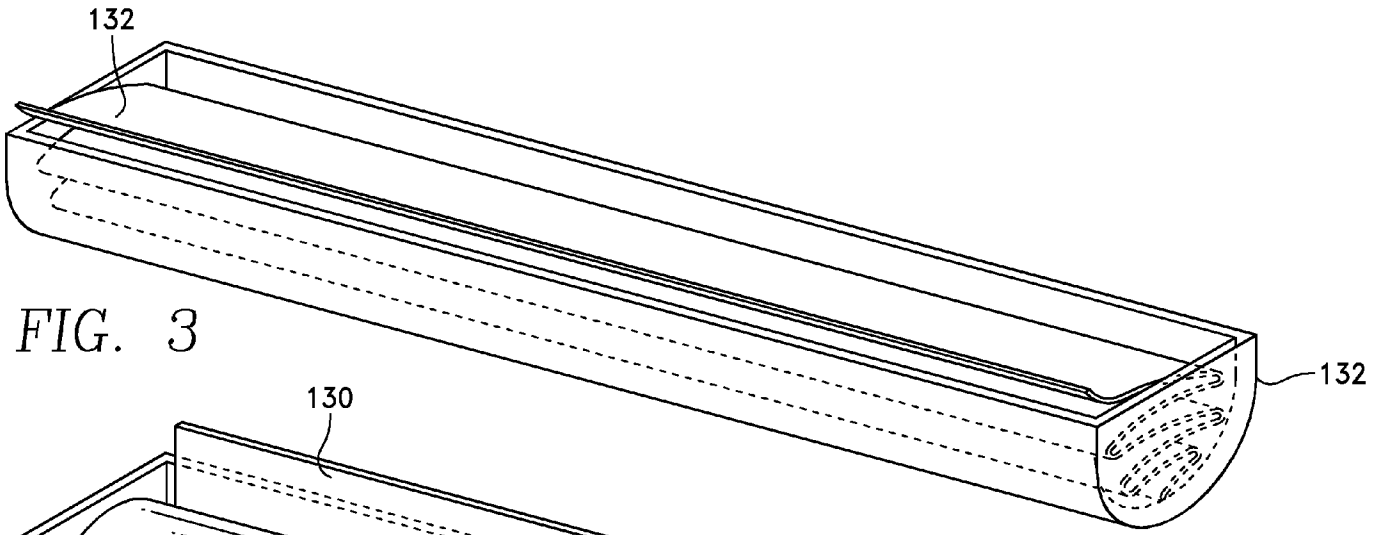
FIG. 3 is a perspective view of an exemplary embodiment of a storage compartment for storing a deployable container of the present invention.
Figure 4:
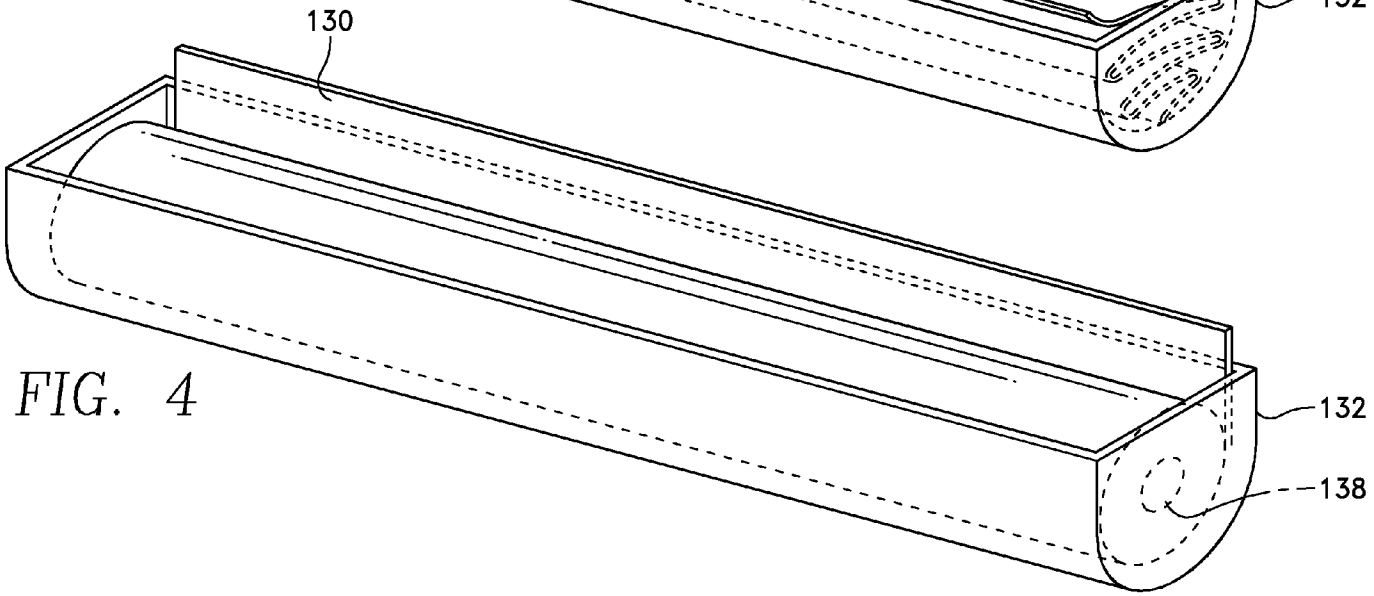
FIG. 4 is a perspective view of another exemplary embodiment of a storage compartment for storing a deployable container of the present invention.

When extendable handle 128 is in unextended position (i.e. pushed down within trolley suitcase 100 such that grip 129 thereof is flush with an upper surface of trolley suitcase 100, deployable container 130 may be folded, accordion-style as shown in FIG. 3, wound on a reel as shown in FIG. 4, or compressed in any suitable manner to allow receipt within container storage housing 132. When extendable handle 128 is extended, as when a user of trolley suitcase 100 is transporting the suitcase by pulling it, deployable container 130 may automatically extend due to the attachment of first end 131 of the deployable container to extendable handle 128. Alternatively, a user may manually retrieve deployable container 130 from container storage housing 132, manually extending deployable container 130 to provide the interim storage space.

FIGS. 3 and 4 provide close views of embodiments of container storage housing 132 of the present invention. As shown in the figures, container storage housing 132 is preferably provided in the shape of a semi-circular trough, roughly similar in shape to a cylinder cut along its longitudinal axis. When deployable container 130 is in stored configuration as shown in FIG. 3, deployable container 130 is folded or otherwise compressed to fit within container storage housing 132. In this embodiment, deployable container 130 folded accordion-style within container storage housing 132. In this embodiment of the present invention, deployable container 130 is designed to fold onto itself in the manner shown when extendable handled 128 is returned to unextended position, or when deployable container 130 is otherwise returned to storage compartment 132. As shown in FIG. 4, in some embodiments of the present invention, storage container housing 132 may include a reel 138 for retracting deployable container 130. Such a reel is typically under the influence of a torsion spring, which urges the reel to turn such that deployable container 130 is wound thereupon. Reel 138 may include, in addition to a spring, a sleeve on which deployable container 130 is wound and unwound, a locking mechanism to allow deployable container 130 to remain in deployed configuration without attachment to another location on trolley suitcase 100, and so on. The construction and operation of such reel mechanisms are well known in the art.

In some embodiments of the invention, rather than employing a storage compartment 32, deployable container 130 may simply be stored in the same space as the extendable handle 128 when extendable handle 128 is in stored configuration. In such embodiments, both the first end 131 and second end 133 of deployable container 130 may be attached to extendable handle 128, such that deployable container 130 descends within the body of trolley suitcase 110 when extendable handle 128 is pushed inward to an unextended position. Alternatively, first end 131 of deployable container 130 may be attached to a separate structure within the opening that receives extendable handle 128 in its unextended form, with the first end 131 being attached along the length of extendable handle 128 such that the deployable container 130 is deployed when extendable handle 128 is in its extended configuration. In some embodiments of the invention, the second end 133 of extendable handle 128 may be attached to grip 129 of the extendable handle.

Figure 5:
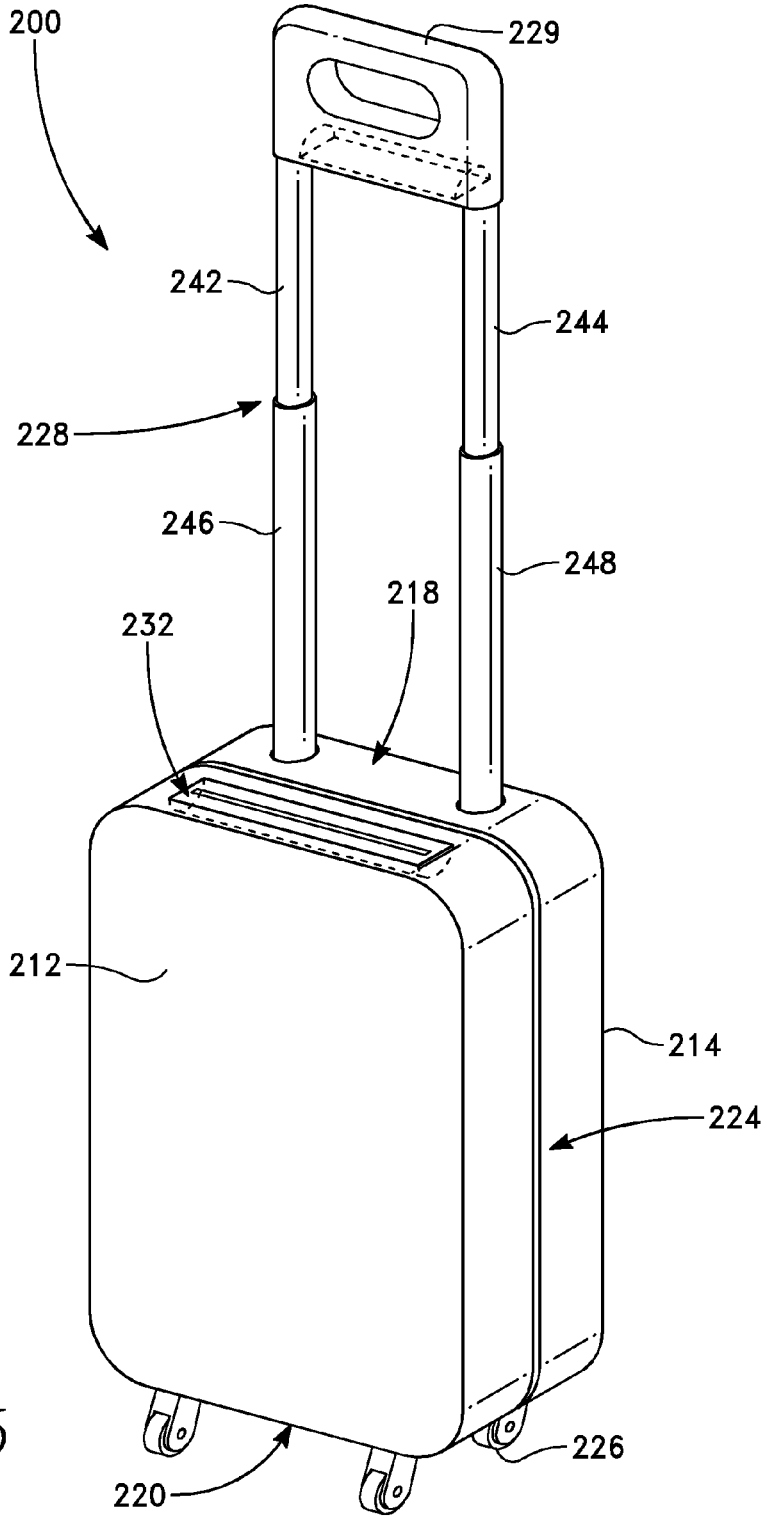
FIG. 5 is a perspective view of another exemplary embodiment of a trolley suitcase with deployable container of the present invention.

In other embodiments of the invention, such as that shown in FIG. 5, for example, trolley suitcase 200 may include a deployable container 230 with a first end 233 that is attached to a container storage housing 232 contained within front panel 212. The second end 231 of deployable container 230 may be attached to a portion of extendable handle 228. When extendable handle 228 is unextended and deployable container 230 is in stored configuration, deployable container 230 is contained within container storage housing 232. When extendable handle 230 is extended, second end 231 of deployable container 230 moves away from first end 233, expanding deployable container 230. Again, deployment of deployable container 230 may occur automatically when handle 228 is extended, or may be performed manually by a user of the present invention.

Figure 6:
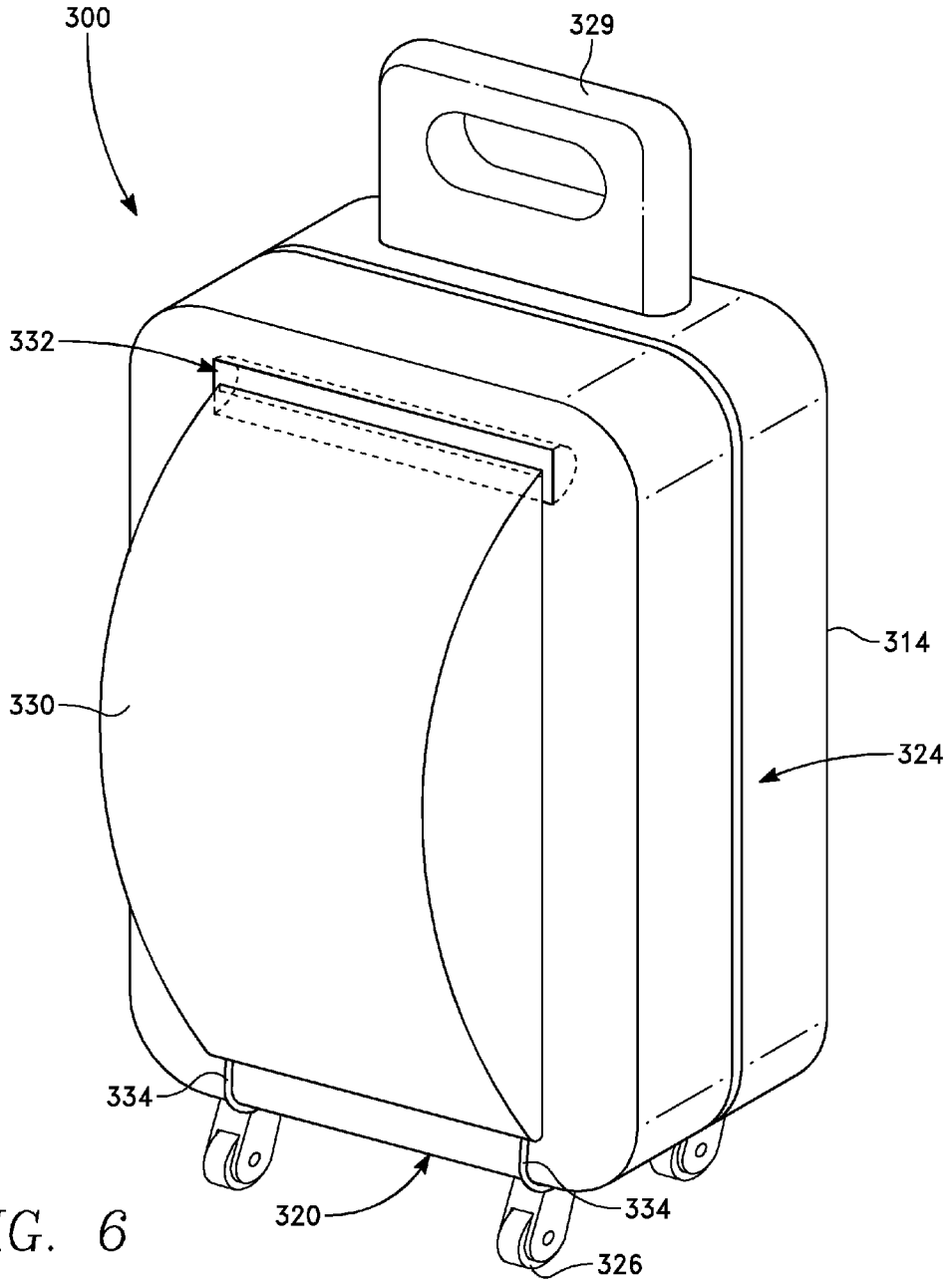
FIG. 6 is a perspective view of another exemplary embodiment of a trolley suitcase with deployable container of the present invention.

In embodiments of the invention such as that shown in FIG. 6, deployable container 330 may extend across the front panel 312 of trolley suitcase 310, rather than from an upper surface of trolley suitcase 310 to a point along retractable handle 328. A container storage housing 332 may be provided in the interior of trolley suitcase 310, as shown in the Figure. Attachments 334, such as, for example, hooks, may be provided at another point along front panel 312. When a user of trolley suitcase 310 deploys deployable container 330, deployable container 330 extends from a first end 331 at or near the location of storage compartment 332, to the attachments 334, which interact with the second end 333 of deployable container 330 to secure the second end 333 to the attachments 334. Deployable container 330 is defined between the first and second ends, extending between the attachments and storage compartment 332. It is contemplated, however, that in some embodiments of the invention, attachments 334 may not be required, and deployable container 330 may be operated via the use of a reel, as described below.

Figure 7:
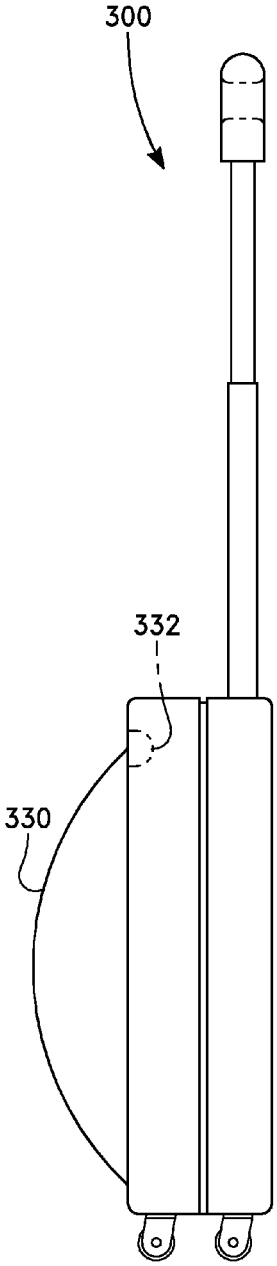
FIG. 7 is a side view of the exemplary embodiment of a trolley suitcase with deployable container of the present invention shown in FIG. 6.
Figure 8:
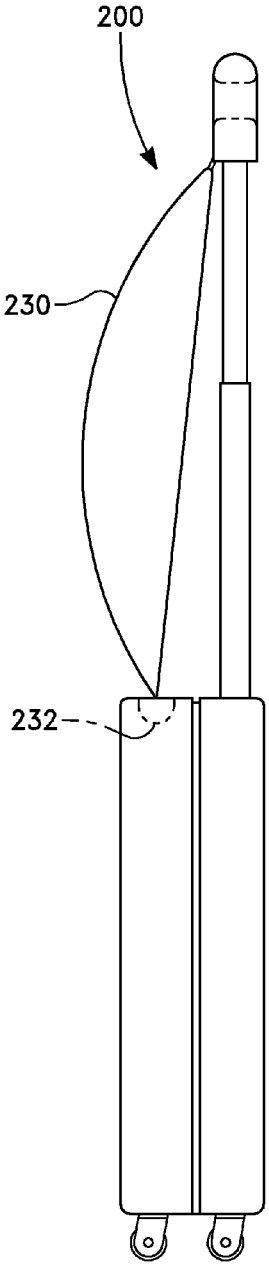
FIG. 8 is a side view of the exemplary embodiment of a trolley suitcase with deployable container of the present invention shown in FIG. 5.
Figure 9:
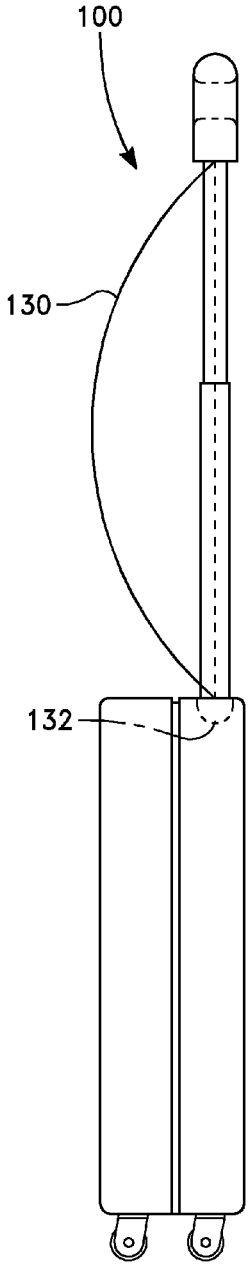
FIG. 9 is a side view of the exemplary embodiment of a trolley suitcase with deployable container of the present invention shown in FIG. 2.

FIGS. 7 through 9 show side views of various embodiments of the present invention described above. FIG. 7 shows a side view of the embodiment of the present invention shown in FIG. 6, with deployable container 330 extending over front panel 312 of trolley suitcase 300. FIG. 8 shows a side view of the embodiment of the present invention shown in FIG. 5, with deployable container 230 extending from extendable handle 228 to container storage housing 232 in the top of front panel 212 of trolley suitcase 200. FIG. 9 shows a side view of the embodiment of the present invention shown in FIG. 2, with deployable container 130 extending from extendable handle 128 to container storage housing 132 in the top of rear panel 114 of trolley suitcase 100.

Figure 10:
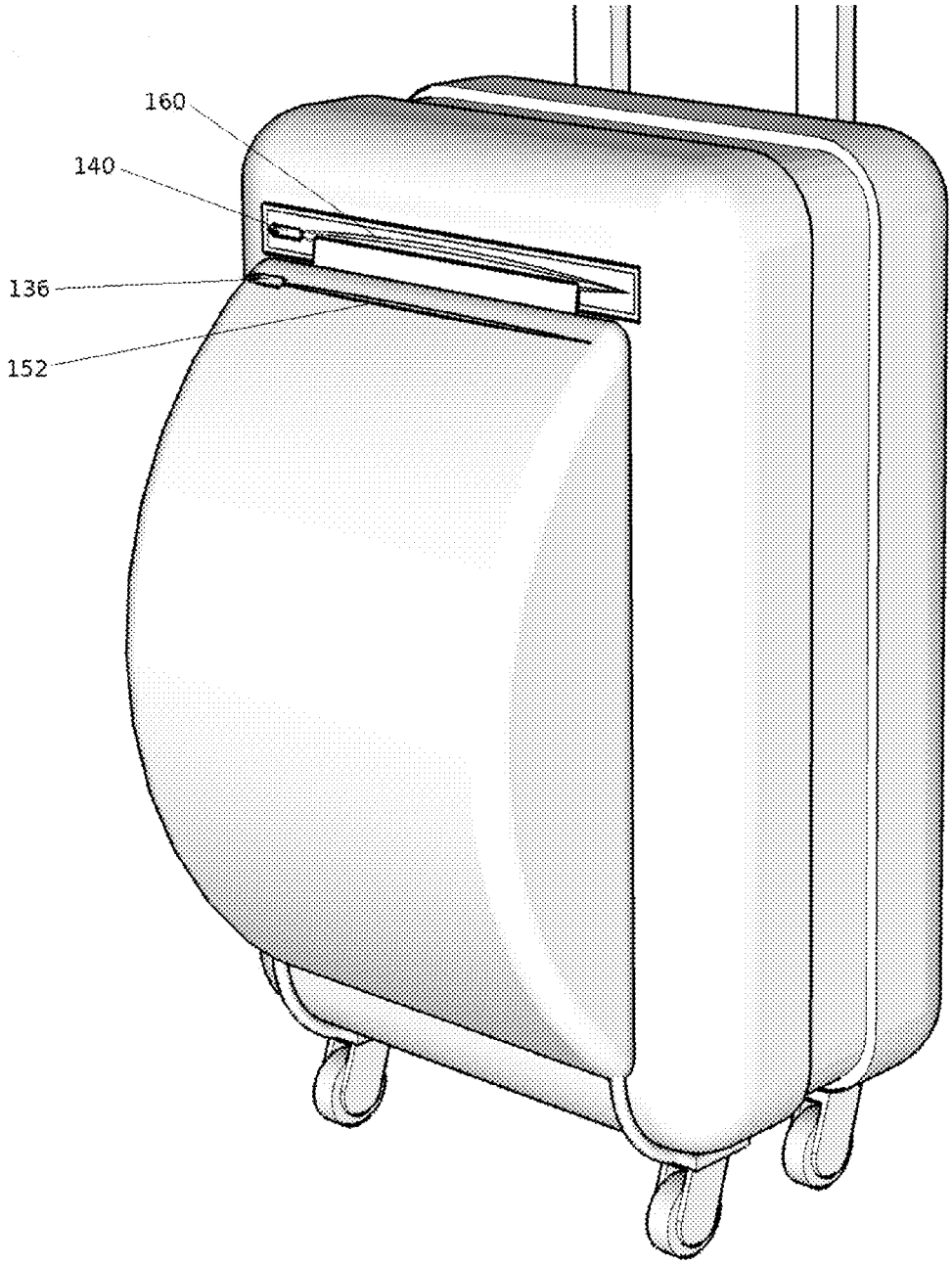
FIG. 10 is a perspective view of one embodiment of the present invention showing an opening in the deployable container and a zipper for access thereto and an opening in the body of the trolley suitcase for access to the container storage housing.

As best shown in FIG. 10, an opening 152 is preferably provided along the length of deployable container 130 to allow access to the interior of deployable container 130 by a user of the present device. The opening may be secured with a zipper 136 such that a user can open and close deployable container 130. Other suitable openings and methods or structures for securing the openings may also be used.

Also as best shown in FIG. 10, a zipper 140 may be provided to allow a user to open container storage housing 132, via an opening 160, for deployment of deployable container 130 in any of the embodiments of the present invention described herein. Zipper 140 may prevent inadvertent deployment of deployable container 130. Any suitable fastener may be used in place of zipper 140.

It should be noted that the foregoing description and accompanying drawings are exemplary of certain embodiments of the invention. Various modifications to, and alternative embodiments of, the present device will be readily apparent to those of skill in the art upon reading this disclosure, and it is contemplated that such modifications and alternative embodiments are within the spirit and scope of the claims that follow.

Having thus described the preferred embodiment of the invention, what is claimed as new and desired to be protected by Letters Patent includes the following:

1. A suitcase comprising:

a front panel having a top edge, a bottom edge, and first and second opposing side edges;

a back panel having a top edge, a bottom edge, and first and second opposing side edges, the front and back panels defining an main storage compartment;

an extendable handle having a length and extending from the top edge of the back panel and moveable between a recessed position and an extended position; and an integrated deployable compartment that is deployable to define an enclosed auxiliary storage compartment external to the main storage compartment, the deployable compartment having a stored configuration and a deployed configuration, wherein, when in the stored configuration, the auxiliary storage compartment is wound around a reel within a storage housing defining a compartment storage space, and wherein when in the deployed configuration, a first end thereof is retained on said reel while a second end thereof is extended away from the first end to a point along the length of the extendable handle, with the auxiliary storage compartment defined between the first end and the second end.

2. The suitcase according to claim 1, wherein the storage housing is contained within one of the front panel and the back panel, and further wherein the compartment storage space defined by the storage housing is separate from the main storage compartment.

3. The suitcase according to claim 1, wherein the deployable compartment defines an access opening in an outer surface thereof for allowing access into an interior space of the deployable compartment.

4. The suitcase according to claim 3, wherein the access opening comprises a fastener for opening and closing the access opening.

5. The suitcase according to claim 4, wherein the fastener is a zipper.

6. The suitcase according to claim 1, wherein the deployable container is deployed between a stored configuration and a deployed configuration by an automatic mechanism.

7. The suitcase according to claim 1, wherein the position of the first end of the deployable container when in deployed configuration is at a first location along said front panel, and the position of the second end of the deployable container when in deployed configuration is at a second location along said front panel, the second location being removed from the first location.

8. The suitcase according to claim 7, wherein the front panel comprises a storage container housing, wherein the storage container housing is positioned at the first location along the front panel and the first end of the deployable container is attached to the storage container housing.

9. The suitcase according to claim 7, wherein the front panel comprises an attachment at the second location therealong, and further wherein the deployable container comprises an attachment at the second end thereof, the attachment of the front panel adapted to attach to the attachment of the deployable container.

10. The suitcase according to claim 8, wherein the storage container housing comprises a reel.

11. A suitcase comprising:

a front panel having a top edge, a bottom edge, and first and second opposing side edges;

a back panel having a top edge, a bottom edge, and first and second opposing side edges, the front and back panels defining a main storage compartment;

an extendable handle moveable between a recessed position and an extended position extending from the top edge of the back panel; and an integrated deployable, enclosed compartment extending between a first point along the length of the extendable handle and a reel, wherein the reel is configured to receive the deployable compartment wound therearound, and further wherein the reel is positioned at a location selected from the group consisting of the front panel, the back panel, and a second point along the length of the extendable handle.

* * * * *